US010745772B2

(12) United States Patent
Tanaka et al.

(10) Patent No.: US 10,745,772 B2
(45) Date of Patent: Aug. 18, 2020

(54) AGE HARDENING NON-HEAT TREATED BAINITIC STEEL

(71) Applicants: DAIDO STEEL CO., LTD., Aichi (JP); DENSO CORPORATION, Aichi (JP)

(72) Inventors: Yuuki Tanaka, Aichi (JP); Makoto Haritani, Aichi (JP); Takahiro Miyazaki, Aichi (JP); Kouji Morita, Aichi (JP); Yoshihiro Tanimura, Aichi (JP); Toshimasa Ito, Aichi (JP); Tadashi Nishiwaki, Aichi (JP); Tomomitsu Fukuoka, Aichi (JP)

(73) Assignees: DAIDO STEEL CO., LTD., Aichi (JP); DENSO CORPORATION, Aichi (JP)

( * ) Notice: Subject to any disclaimer, the term of this patent is extended or adjusted under 35 U.S.C. 154(b) by 467 days.

(21) Appl. No.: 15/123,076

(22) PCT Filed: Mar. 3, 2015

(86) PCT No.: PCT/JP2015/056206
§ 371 (c)(1),
(2) Date: Sep. 1, 2016

(87) PCT Pub. No.: WO2015/133470
PCT Pub. Date: Sep. 11, 2015

(65) Prior Publication Data

US 2017/0073785 A1 Mar. 16, 2017

(30) Foreign Application Priority Data

Mar. 5, 2014 (JP) ..... 2014-043044

(51) Int. Cl.

| | |
|---|---|
| ***C21D 6/00*** | (2006.01) |
| ***C22C 38/42*** | (2006.01) |
| ***C22C 38/44*** | (2006.01) |
| ***C22C 38/48*** | (2006.01) |
| ***C22C 38/60*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/46*** | (2006.01) |
| ***C22C 38/50*** | (2006.01) |
| ***C21D 6/02*** | (2006.01) |
| ***C22C 38/58*** | (2006.01) |

(52) U.S. Cl.

CPC ..... *C21D 6/008* (2013.01); *C21D 6/004* (2013.01); *C21D 6/005* (2013.01); *C21D 6/02* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *C22C 38/60* (2013.01); *C21D 6/00* (2013.01); *C21D 2211/002* (2013.01)

(58) Field of Classification Search

CPC ..... C22C 38/02; C22C 38/06; C22C 38/04; C22C 38/22; C22C 38/24; C22C 38/28; C22C 38/42; C22C 38/44; C22C 38/60; C22C 38/12; C22C 38/14; C22C 38/16; C22C 38/08; C22C 38/38; C22C 38/48; C22C 38/00; C22C 38/20; C22C 38/26; C22C 38/18; C22C 38/40; C21D 2211/002; C21D 8/005; C21D 6/004; C21D 6/005; C21D 6/008

USPC ..... 148/333, 307, 310, 320, 328, 334, 547; 420/104, 105, 110, 112, 120, 124, 126, 420/127, 92, 93

See application file for complete search history.

(56) References Cited

U.S. PATENT DOCUMENTS 9,187,797 B2 11/2015 Teramoto et al.
10,066,281 B2 * 9/2018 Higashida ..... C22C 38/00
(Continued)

FOREIGN PATENT DOCUMENTS

EP 1167561 A2 1/2002
EP 2357262 A1 * 8/2011 ..... B21K 1/08
(Continued)

OTHER PUBLICATIONS

International Search Report issued with respect to Application No. PCT/JP2015/056206, dated Apr. 7, 2015.
(Continued)

*Primary Examiner* — Matthew E. Hoban
*Assistant Examiner* — Lynne Edmondson
(74) *Attorney, Agent, or Firm* — Greenblum & Bernstein, P.L.C.

(57) ABSTRACT

The present invention provides an age hardening type bainitic microalloyed steel having a composition which includes, in terms of mass %: 0.06-0.35% of C; 0.01-2.00% of Si; 0.10-3.00% of Mn; 0.001-0.200% of S; 0.001-2.00% of Cu; 0.40-3.00% of Ni; 0.10-3.00% of Cr; 0.10-1.00% of Mo; 0.10-1.00% of V; and 0.001-0.100% of s-Al, with the remainder being Fe and unavoidable impurities, and which satisfies a value of the following expression (1) to be 20 or larger and a value of the following expression (2) to be 0.82 or larger:

$$3\times[C]+10\times[Mn]+2\times[Cu]+2\times[Ni]+12\times[Cr]+9\times[Mo]+2\times[V] \quad \text{expression (1);}$$

$$1.66\times[C]+0.18\times[Si]+0.27\times[Mn]+0.09\times[Ni]+0.32\times[Cr]+0.34\times[Mo]+0.44\times[V] \quad \text{expression (2),}$$

in which each [ ] in the expression (1) and the expression (2) indicates a content of the element shown therein in terms of mass %.

8 Claims, 2 Drawing Sheets

(56) References Cited

U.S. PATENT DOCUMENTS

| | | | | |
|---|---|---|---|---|
| 2002/0026970 | A1 | 3/2002 | Hirofumi et al. | |
| 2004/0108020 | A1* | 6/2004 | Dierickx | C21D 1/02 148/547 |
| 2007/0163687 | A1* | 7/2007 | Kurosawa | C21D 9/30 148/566 |
| 2010/0263773 | A1* | 10/2010 | Cho | C22C 38/02 148/645 |
| 2013/0186529 | A1 | 7/2013 | Teramoto et al. | |
| 2013/0340899 | A1 | 12/2013 | Kazuhisa et al. | |
| 2015/0034049 | A1 | 2/2015 | Matsui et al. | |

FOREIGN PATENT DOCUMENTS

| | | | |
|---|---|---|---|
| EP | 2671963 | A1 | 11/2013 |
| JP | H01-177338 | A | 7/1989 |
| JP | 2001-192765 | A | 7/2001 |
| JP | 2004-190138 | A | 7/2004 |
| JP | 2005-226158 | A | 8/2005 |
| JP | 2006-37177 | A | 2/2006 |
| JP | 2008-223083 | A | 9/2008 |
| JP | 2011-236452 | A | 11/2011 |
| JP | 2011-241441 | A | 12/2011 |
| JP | 2012-193416 | A | 10/2012 |
| JP | 2012-246527 | A | 12/2012 |
| JP | 2013-166983 | A | 8/2013 |
| JP | 2013-245363 | A | 12/2013 |
| JP | 2013-253265 | A | 12/2013 |
| WO | 2010-090238 | A1 | 8/2010 |

OTHER PUBLICATIONS

International Preliminary Report on Patentability issued with respect to Application No. PCT/JP2015/056206, dated Sep. 6, 2016.

Extended European Search Report from Application No. 15759094.4 dated Sep. 28, 2017.

Japanese Office Action issued with respect to Application No. 2015-042253, dated Jun. 12, 2018, with English translation.

Office Action in corresponding European Patent Application No. 15759094.4, dated Mar. 21, 2019.

* cited by examiner

AGE HARDENING NON-HEAT TREATED BAINITIC STEEL

TECHNICAL FIELD

The present invention relates to an age hardening type bainitic microalloyed steel which has a bainite structure after hot working and which, through a subsequent age hardening treatment, undergoes precipitation hardening to come to have high hardness. More particularly, the present invention relates to an age hardening type bainitic microalloyed steel having higher fracture toughness than conventional ones.

BACKGROUND ART

Hitherto, thermal-refined steels, which are steels required to undergo a quenching and tempering treatment (thermal refining, treatment) after hot working, e.g., hot forging, have been used for parts required to have strength and toughness, such as automotive parts and structural machine parts.

However, thermal-refined steels, although excellent in terms of strength and toughness, have a problem in that the cost of heat treatment for the quenching and tempering treatment (thermal refining treatment) performed for part production after hot working is high. In addition, there are problems in that since the martensitic transformation results in large heat-treatment strains, a large amount of machining is necessary for correcting the shape and dimensions after the heat treatment, resulting in an impaired yield, and that since this machining is given to the work which is in a hard martensitic state, the work shows poor machinability (workability), resulting in a prolonged period for part production and in an increased cost.

Microalloyed steels are steels which, in the as-hot-rolled state (specifically, in the state of having been hot-worked and subsequently cooled mainly by air cooling), exhibit required hardness and which can have the desired strength even when the quenching and tempering treatment after the hot working is omitted. Microalloyed steels are hence extensively used in applications such as structural machine parts, etc., as thermal-refined-steel substitute materials capable of accommodating cost reductions.

As such microalloyed steels, there is a ferrite/pearlite type microalloyed steel obtained by adding a slight amount of V to a medium-carbon steel. However, for enhancing the strength of the ferrite/pearlite type microalloyed steel to a certain level or above, it is necessary to heighten the areal proportion of pearlite to such a degree that the steel is substantially constituted of a pearlite phase alone.

In this case, however, since this steel has a structure consisting mainly of pearlite, which is brittle as compared with ferrite, the steel undesirably has considerably reduced toughness. It is hence difficult to enhance the strength to a certain level or above while ensuring toughness.

Among the microalloyed steels, there is a bainitic microalloyed steel which, in a hot-worked state, has a bainite structure. This steel has better toughness than the ferrite/pearlite microalloyed steel, but has a problem in that the proof stress thereof is low.

Merely heightening the hardness in order to improve the proof stress results in deterioration in machinability to increase the load in machining and impair the workability.

Age hardening type bainitic microalloyed steels are being investigated as one means for solution.

An age hardening type bainitic microalloyed steel is a steel which, in a hot-worked state, has a bainite structure and which comes to have heightened strength through a subsequent age hardening treatment. This age hardening type bainitic microalloyed steel, in the state of having undergone hot working and being soft, can be machined, and the hardness thereof can be heightened to required hardness by a subsequent age hardening treatment.

However, the conventional age hardening type bainitic microalloyed steels are still insufficient in toughness as compared with conventional thermal-refined steels, although the toughness thereof is better than that of ferrite/pearlite microalloyed steels.

Meanwhile, the investigations on conventional age hardening type bainitic microalloyed steels have aimed chiefly at increases in hardness and strength, and investigations for heightening toughness have not been made sufficiently.

Under such circumstances, Patent Document 1 describes an invention relating to "a steel part with high fatigue strength and high toughness for machine structure, and a process for producing the same" and discloses that an improvement in toughness was attained by refining bainite laths.

However, the improvement in toughness disclosed in Patent Document 1 is concerned with improvement in impact property (Charpy impact value), and the disclosed steel is still insufficient in fracture toughness, which is a toughness property different from impact properties, and is difficult to apply to parts required to have fracture toughness.

Furthermore, the steel described in Patent Document 1 requires a high cooling rate, and this imposes a large limitation on the production thereof.

With respect to other background-art techniques which are relevant to the present invention, Patent Document 2 describes an invention relating to "a steel for carburizing and carbonitriding" and discloses that, in a steel for carburizing and carbonitriding which is for use in gear and shaft applications required to have both high pitching fatigue strength and high impact strength, the temper hardness is improved by increasing the content of Si and the fracture toughness value of the carburized phase and core portion is improved by adding Ni or Mo alone or Ni and Mo in combination.

However, the steel described in Patent Document 2 basically differs from the steel of the present invention in that the former is not an age hardening type bainitic microalloyed steel.

Patent Document 3 describes an invention relating to "a rolled steel bar for hot forging and a material roughly shaped by hot forging" and discloses that, in case where the value of expression Fn1, which is a parameter serving as an index of the influence on tensile strength, exceeds 1.20, bainite is formed after hot forging in the material roughly shaped by the hot forging, resulting in a decrease in fracture toughness value, and alloying components are hence regulated so that the value of Fn1 is 1.20 or less.

However, the steel disclosed in Patent Document 3 differs from the steel of the present invention in that the former steel has a ferrite/pearlite structure and is not an age hardening type bainitic microalloyed steel and that the former steel has a content of Ni as low as 0.20% or less.

Patent Document 4 describes an invention relating to "an age hardening steel" and discloses an age hardening steel which, before an age hardening treatment, has a bainite-structure areal proportion of 50% or higher and in which the hardness increases, through the age hardening treatment, by 7 HRC or more from the hardness before the age hardening treatment.

The steel described in Patent Document 4 may contain Ni as an optional additive component, and the content thereof has been specified in the claims so as to be 1.0% or less.

However, there is no Example in which Ni has been added. The steel described in Patent Document 4 substantially is a steel containing no Ni, and is different from the steel of the present invention.

BACKGROUND ART DOCUMENT

Patent Document

Patent Document 1: JP-A-2012-246527
Patent Document 2: JP-A-2001-192765
Patent Document 3: JP-A-2013-166983
Patent Document 4: JP-A-2006-037177

SUMMARY OF THE INVENTION

Problems that the Invention is to Solve

An object of the present invention, which has been achieved under the circumstances described above, is to provide an age hardening type bainitic microalloyed steel which comes to have a higher fracture toughness value than conventional ones.

Means for Solving the Problems

The present invention relates to the following [1] to [4].

[1] An age hardening type bainitic microalloyed steel having a composition which includes, in terms of mass %:
0.06-035% of C;
0.01-2.00% of Si;
0.10-3.00% of Mn;
0.001-0.200% of S;
0.001-2.00% of Cu;
0.40-3.00% of Ni;
0.10-3.00% of Cr;
0.10-1.00% of Mo;
0.10-1.00% of V; and
0.001-0.100% of s-Al,
with the remainder being Fe and unavoidable impurities, and which satisfies a value of the following expression (1) to be 20 or larger and a value of the following expression (2) to be 0.82 or larger:

$$3\times[C]+10\times[Mn]+2\times[Cu]+2\times[Ni]+12\times[Cr]+9\times[Mo]+2\times[V] \quad \text{expression (1);}$$

$$1.66\times[C]+0.18\times[Si]+0.27\times[Mn]+0.09\times[Ni]+0.32\times[Cr]+0.34\times[Mo]+0.44\times[V] \quad \text{expression (2),}$$

in which each [ ] in the expression (1) and the expression (2) indicates a content of the element shown therein terms of mass %.

[2] The age hardening type bainitic microalloyed steel according to [1], in which the composition further satisfies a value of the following expression (3) to be 600 or larger:

$$727+21.2\times[Si]-37.8\times([Mn]+[Ni])+13.5\times[Cr]+2.7\times[Mo] \quad \text{expression (3),}$$

in which each [ ] in the expression (3) indicates a content of the element shown therein in terms of mass %,

[3] The age hardening type bainitic microalloyed steel according to [1] or [2], further including, in terms of mass %, either or both of:
up to 0.300% of Ti; and
up to 0.300% of Nb.

[4] The age hardening type bainitic microalloyed steel according to any one of [1] to [3], further including, in terms of mass %, one or more of:
0.001-0.300% of Pb;
0.001-0.300% of Bi;
0.001-0.300% of Te; and
0.001-0.010% of Ca.

Advantage of the Invention

According to the present invention, which has such configurations, it is possible to provide an age hardening type bainitic microalloyed steel that comes to have a higher fracture toughness value than conventional ones. This age hardening type bainitic microalloyed steel is suitable for application to parts required to have fracture toughness.

MODE FOR CARRYING OUT THE INVENTION

Figure 1A:
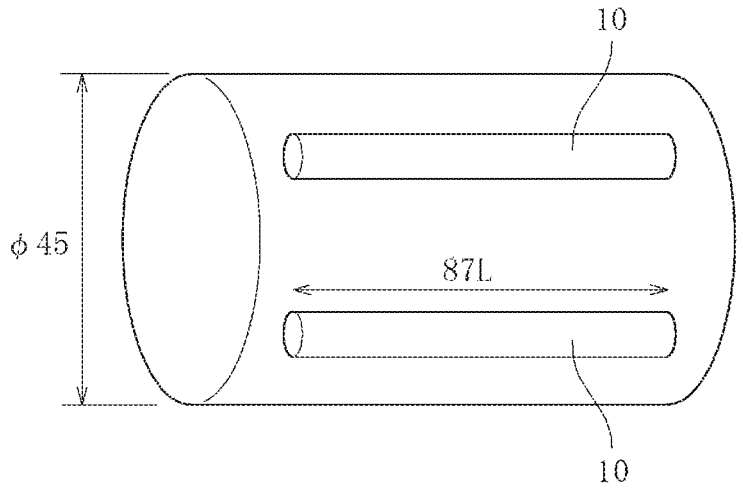
FIG. 1(A) is a view for explaining acquisition of tensile test specimens.

As stated above, one feature of the present invention resides in that the content of Ni therein is made as high as 0.40% or more in terms of mass %, in order to enhance the fracture toughness of the age hardening type bainitic microalloyed steel.

For example, Charpy impact value, which is one of toughness properties, is a property determined by the sum of resistance force required for bringing the crack-free state into the occurrence of a crack and resistance force required for bringing the state in which a crack has occurred into crack propagation and into a rupture. In contrast, fracture toughness value is a property determined by resistance force required when external force is applied to the test specimen in an already cracked state, i.e., the state of having a crack, to propagate the crack. Fracture toughness is a property regarding the resistance of a material to brittle fracture.

In the present invention, the alloying components other than Ni are incorporated in the predetermined amounts as described above and the content of Ni is regulated so as to be as high as 0.40% or more, thereby making it possible to enhance the fracture toughness of the age hardening type bainitic microalloyed steel. According to the present invention, it is possible to obtain a desired fracture toughness value KIC of 50 $MPa\cdot m^{1/2}$ or higher.

Although the reason therefor has not been fully elucidated, it is presumed that due to the increased Ni content, many plastic deformations are apt to occur around the leading end of a crack to render work hardening less apt to occur. As a result, stress relaxation is apt to occur around the crack and stress concentration is less apt to occur therearound, thereby inhibiting crack propagation to attain the enhanced fracture toughness.

It is, however, noted that an Ni content as high as 0.40% or more is necessary for obtaining that effect.

In the present invention, the fracture toughness value KIC means the value measured in accordance with the fracture toughness test method as defined in ASTM-E-399 (2009).

It is desirable that the structure of the age hardening type bainitic microalloyed steel of the present invention before an age hardening treatment is a structure constituted substantially of a bainite phase alone, specifically, a structure in which the areal proportion of bainite structures is 85% or higher. More preferably, the areal proportion thereof is 90% or higher.

In case where ferrite structures coexist in the structure of the steel before an age hardening treatment, not only the age hardenability decreases but also the proof stress ratio and durability ratio decrease, resulting in the concern of a decrease in fatigue strength.

It is therefore desirable that the structure before an age hardening treatment is a structure constituted of a bainite phase alone.

It is desirable that the hardness after the age hardening treatment is 28 HRC (room-temperature hardness) or higher.

In the present invention, the contents of C, Mn, Cu, Ni, Cr, Mo and V are regulated so that the value of expression (1), which is represented by $3\times[C]+10\times[Mn]+2\times[Cu]+2\times[Ni]+12\times[Cr]+9\times[Mo]+2\times[V]$, is 20 or larger.

Furthermore, the contents of C, Si, Mn Ni, Cr, Mo and V are regulated so that the value of expression (2), which is represented by $1.66\times[C]+0.18\times[Si]+0.27\times[Mn]+0.09\times[Ni]+0.32\times[Cr]+0.34\times[Mo]0.44\times[V]$, is 0.82 or larger.

Expression (1) serves as an index for stably forming bainite, while expression (2) serves as an index of the hardness of the steel after an age hardening treatment. These expressions will be explained later in more detail.

In the present invention, it is desirable that the contents of Si, Mn, Ni, Cr and Mo are regulated so that the value of expression (3), which is represented by $727+21.2\times[Si]-37.8\times([Mn]+[Ni])+13.5\times[Cr]+2.7\times[Mo]$, is 600 or larger (see [2] described above).

Expression (3) serves as an index indicating the difficulty of the formation of island martensite. By regulating the composition so that the value of expression (3) is 600 or larger, the formation of island martensite can be inhibited and the fracture toughness can be enhanced. Specifically, the regulation makes it easy to obtain the desired room-temperature fracture toughness value KIC of 50 $MPa\cdot m^{1/2}$ or higher.

In the present invention, either or both of Ti and Nb can be incorporated in the predetermined amount according to need.

Furthermore, one or more of Pb, Bi, Te and Ca can be incorporated in the predetermined amounts.

The age hardening type bainitic microalloyed steel of the present invention can be produced, for example, in the following manner.

After rolling or hot forging such as rough forging, or after a solution treatment, the steel is cooled in the temperature range of 800-300° C. at an average cooling rate of 0.05-10° C./sec usually by air cooling. Thus, the age hardening type bainitic microalloyed steel can be produced.

Thereafter, the steel is subjected according to need to working such as machining and plastic working, and then subjected to an age hardening treatment in which the steel is held at a temperature of 500-700° C. for 0.5-10 hours. Thus, a part having excellent fracture toughness and the desired hardness can be obtained.

Next, the reasons for the limitation of the content of each chemical component, etc. in the present invention are described below. Incidentally, "%" for expressing the content of each chemical component is "mass %".

C: 0.06-0.35%

C not only is an element necessary for ensuring strength but also serves to precipitate carbides of Mo and V through an age hardening treatment to enhance the strength of the steel. For attaining such functions, it is necessary that C is contained in an amount of 0.06% or more. In case where the content of C is less than 0.06%, the required hardness and strength cannot be ensured.

Meanwhile, in case where C is contained in a large amount exceeding 0.35%, the content of cementite increases to impair the toughness. Consequently, an upper limit of the C content is 0.35%.

The C content is more preferably 0.08 to 0.16%.

Si: 0.01-2.00%

Si is added not only as a deoxidizer during melting for steel production but also for the purpose of strength improvement. For these functions, it is necessary that Si is contained in an amount of 0.01% or more.

Meanwhile, in case where Si is contained in a large amount exceeding 2.00%, this is a cause of a decrease in the life of the die, etc. Consequently, an upper limit of the Si content is 2.00%.

The Si content is more preferably 0.10-1.00%.

Mn: 0.10-3.00%

It is necessary that Mn is contained in an amount of 0.10% or more for ensuring quenchability (ensuring bainite structures), improving the strength, and improving the machinability (MnS crystallization). However, in case where Mn is contained in a large amount exceeding 3.00%, this leads to the formation of martensite. Consequently, an upper limit of the Mn content is 3.00%.

The Mn content is more preferably 0.50-2.00%.

S: 0.001-0.200%

It is necessary that S is contained in an amount of 0.001% or more in order to ensure machinability. However, in case where S is contained in a large amount exceeding 0.200%, this is a cause of a deterioration in producibility. Consequently, an upper limit of the S content is 0.200%.

The S content is more preferably 0.010-0.120%.

Cu: 0.001-2.00%

Cu is incorporated in order to ensure quenchability (ensure bainite structures) and improve the strength. For these functions, it is necessary that Cu is contained in an amount of 0.001% or more. However, in case where Cu is contained in a large amount exceeding 2.00%, this results in an increase in cost and impairs the producibility. Consequently, an upper limit of the Cu content is 2.00%.

The Cu content is more preferably 0.010-1.00%.

Ni: 0.40-3.00%

Ni is an essential component for ensuring toughness (fracture toughness) in the present invention. In order to attain the function, Ni is contained in an amount of 0.40% or more. However, in case where Ni is contained in a large amount exceeding 3.00%, this results in an increase in cost. Consequently, an upper limit of the Ni content is 3.00%.

The Ni content is more preferably more than 0.40% and 2.00% or less, and further preferably 0.50-1.50%.

Cr: 0.10-3.00%

Cr is incorporated in order to ensure quenchability (ensure bainite structures) and improve the strength. For these functions, it is necessary that Cr is contained in an amount of 0.10% or more. However, in case where Cr is contained in a large amount exceeding 3.00%, this results in an increase in cost. Consequently, an upper limit of the Cr content is 3.00%.

The Cr content is more preferably 0.50-2.00%.

Mo: 0.10-1.00%

Mo is incorporated in order to precipitate carbides of Mo through an age hardening treatment to enhance the strength. In order to attain this function, Mo is contained in an amount of 0.10% or more. However, in case where Mo is contained in a large amount exceeding 1.00%, this results in an increase in cost. Consequently, an upper limit of the Mo content is 1.00%.

The Mo content is more preferably 0.20-0.80%.

V: 0.10-1.00%

V, like Mo, serves to precipitate carbides of V through an age hardening treatment to enhance the strength of the steel. For this function, it is necessary that V is contained in an amount of 0.10% or more. However, in case where V is contained in a large amount exceeding 1.00%, this results in an increase in cost. Consequently, an upper limit of the V content is 1.00%.

The V content is more preferably 0.20-0.80%.

s-Al: 0.001-0.100% s-Al is used for deoxidation during melting, and is incorporated in an amount of at least 0.001%. Furthermore, s-Al has the effect of precipitating AlN to refine crystal grains, thereby bringing about an improvement in toughness. However, excessive precipitation of AlN leads to deterioration in machinability. Consequently, an upper limit of the s-Al content is 0.100%.

"s-Al" indicates acid-soluble aluminum, and the quantity thereof is determined by the method described in JIS G 1257 (1994), Appendix 15. The contents of JIS G 1257 (1994) are incorporated herein by reference.

Ti: ≤0.300%

Ti serves to precipitate carbides of Ti through an age hardening treatment to contribute to a further increase in strength. Furthermore, Ti causes TiN precipitation to refine the MnS, thereby contributing to an improvement in workability. Ti can hence be incorporated according to need. However, in case where Ti is contained in a large amount exceeding 0.300%, this results in a decrease in toughness. Consequently, an upper limit of the Ti content is 0.300%.

In the case of incorporating Ti, it is preferred to incorporate Ti in an amount of 0.005% or more.

Nb: 0.300%

Nb serves to precipitate carbides of Nb through an age hardening treatment to contribute to a further increase in strength. However, in case where Nb is contained in a large amount exceeding 0.300%, this results in a decrease in toughness. Consequently, an upper limit of the Nb content is 0.300%.

In the case of incorporating Nb, it is preferred to incorporate Nb in an amount of 0.005% or more.

Either Ti or Nb may be incorporated, or both Ti and Nb can be incorporated.

Pb: 0.001-0.300%

Bi: 0.001-0.300%

Te: 0.001-0.300%

Ca: 0.001-0.010%

These elements can be incorporated as free-cutting elements according to need. However, too high contents thereof result in decreases in strength and hot workability. Consequently, an upper limit for each of Pb, Bi and Te content is 0.300%. An upper limit of the Ca content is 0.010%.

Value of expression (1): ≥20.0 (expression (1) . . . $3\times[C]+10\times[Mn]+2\times[Cu]+2\times[Ni]+12\times[Cr]+9\times[Mo]+2\times[V]$)

Expression (1) serves as an index for stably forming bainite. In the present invention, it is necessary to regulate the value of expression (1) to 20 or larger, from the standpoint of enabling the steel before an age hardening treatment to have a structure constituted substantially of a bainite phase alone, specifically, a structure in which the areal proportion of bainite structures is 85% or higher.

In case where the value of expression (1) is less than 20, ferrite is apt to be formed. In case where ferrite structures coexist in an amount of 15% or more, there is a problem in that not only the age hardenability decreases but also the proof stress ratio and the durability ratio also decrease, resulting in a decrease in fatigue strength.

The value of expression (1) is preferably 25 or larger and 50 or less. So long as the value of expression (1) is 50 or less, martensite is not formed and excellent machinability can be obtained.

Value of expression (2): ≥0.82 (expression (2) . . . $1.66\times[C]+0.18\times[Si]+0.27\times[Mn]+0.09\times[Ni]+0.32\times[Cr]+0.34\times[Mo]+0.44\times[V]$).

Expression (2) serves as an index of the hardness of the steel after an age hardening treatment. The larger the value thereof, the higher the hardness after an age hardening treatment.

In the present invention, for obtaining the desired hardness of 28 HRC or higher after age hardening, it is necessary that the value of expression (2) is 0.82 or larger.

The value of expression (2) is preferably 1.00 or more and 3.76 or less.

Value of expression (3): ≥600 (expression (3) . . . $727+21.2\times[Si]-37.8\times([Mn]+[Ni])+13.5\times[Cr]+2.7\times[Mo]$)

Expression (3) serves as an index indicating the difficulty of the formation of island martensite. The smaller the value thereof, the more the formation of island martensite is apt to occur, resulting in a decrease in fracture toughness value.

Conversely, the larger the value thereof, the less the formation of island martensite occurs. In cases when the value of expression (3) satisfies 600 or larger, the formation of island martensite can be effectively inhibited and high toughness (fracture toughness) is apt to be obtained. The value of expression (3) is more preferably 640 or larger, further preferably 640 or larger and 780 or less.

Specifically, the value of expression (3) indicates the temperature at which austenite is formed by reverse transformation when the bainitic steel is subjected to an age hardening treatment.

In cases when the value of expression (3) is, for example, 650, austenite is not formed by reverse transformation when an age hardening treatment is conducted at 640° C. The larger the value of expression (3) beyond that value, the less the austenite formation occurs.

The present inventors directed attention to the fact that in the case of age hardening type bainitic microalloyed steels, the fracture toughness will not improve through an age hardening treatment. The present inventors searched for reasons therefor and, as a result, discovered that the bainitic, in fact, undergoes a reverse transformation into austenite during the age hardening treatment and some of the austenite becomes martensite during the subsequent cooling to form an island martensite phase around the residual austenite and that the fracture toughness is considerably decreased due to the island martensite.

The present inventors hence made investigations on the basis of the idea that for overcoming the problem newly discovered by the present inventors, it is effective to inhibit the austenization of bainite through reverse transformation in an age hardening treatment. As a result, the present inventors have found that by regulating the value of expression (3), which indicates the temperature at which austenite is formed by reverse transformation, to 600 or larger, the formation of island martensite during an age hardening treatment can be satisfactorily inhibited and the fracture toughness can be advantageously enhanced.

Since the value of expression (3) is affected by components such as Si, Mn, Ni, Cr and Mo, it is desirable in the present invention that the contents of these components are regulated so that the value of expression (3) is 600 or larger.

EXAMPLES

Steels respectively having the chemical compositions shown in Table 1 and Table 2 in an amount of 150 kg each were smelted with a vacuum induction melting furnace, and were drawn with forging at 1,250° C. into Φ60-mm round bars. Thereafter, each Φ60-mm round bar material was heated to 1,250° C., forged into a Φ45-mm round bar under the forging conditions of 1,100° C., and then air-cooled to room temperature.

Thereafter, an age hardening treatment was performed under the condition of 550-675° C. for 2 hours. The round bars were then subjected to a tensile test, hardness test, microstructure examination, and fracture toughness test.

Besides these examinations, the hardness test was given also to the forged round bars after being air-cooled, i.e., in the state of having not undergone the age hardening treatment.

The tensile test, hardness test, microstructure examination, and fracture toughness test were conducted in the following manners.

"Φ" represents diameter.

<Tensile Test>

With respect to tensile test, rod-shaped materials 10 for tensile test were taken out from the Φ45-mm round bar as shown in FIG. 1(A), and JIS Z 2241 (2011) No. 14A test specimens each having a parallel-portion diameter of 6 mm and equipped with an M10 threaded portion at each of both ends were produced from the materials 10. A tensile test was performed under the conditions of a pulling speed of 1 mm/sec to determine a 0.2% proof stress ratio (0.2% proof stress/tensile strength). Steels having a 0.2% proof stress ratio not less than a desired value of 0.80 are rated as good (○), and steels having a 0.2% proof stress ratio of less than 0.80 are rated as poor (×), the results of the evaluation are shown in Table 3. In Table 3 are also shown the numerical values of proof stress ratio together with the evaluation results "○" and "×".

<Hardness Test>

The hardness test was conducted in accordance with JIS Z 2245 (2011) using a Rockwell hardness meter and a conical diamond indenter with a load of 150 kgf.

The hardness measurement was made on (radius)×½ portions of each test specimen.

<Microstructure Examination>

With respect to microstructure examination, each test specimen was subjected to Nital corrosion and then examined with an optical microscope (magnification: 400 times) to determine the proportion of bainite. With respect to the proportion of bainite, the evaluation is as follows: the case where the areal proportion of bainite structures was 85% or higher is indicated by "○"; the case where the steel was a mixture of bainite structures and ferrite structures (areal proportion of ferrite structures: 15% or higher is indicated by "×F"; and the case where the steel was a mixture of bainite structures and martensite structures areal proportion of martensite structures: 15% or higher) is indicated by "×M".

In the table, the actually measured areal proportions of bainite are also shown in the parentheses together with the evaluation results "○", "×F" and "×M".

<Fracture Toughness Test>

The fracture toughness test was conducted in accordance with ASTM-E-399.

Figure 1B:
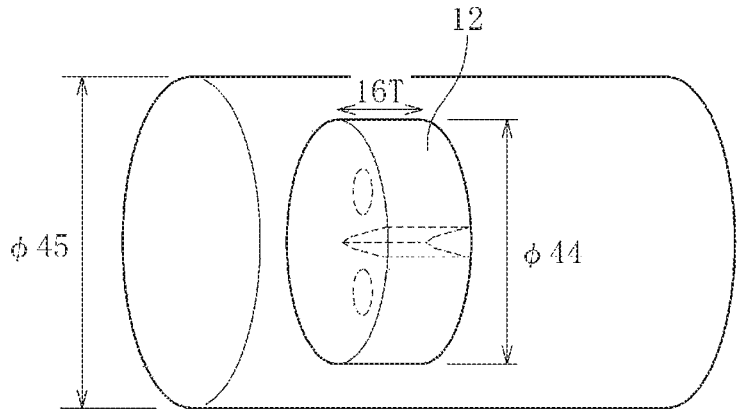
FIG. 1(B) is a view for explaining acquisition of a fracture toughness test specimen.
Figure 2:
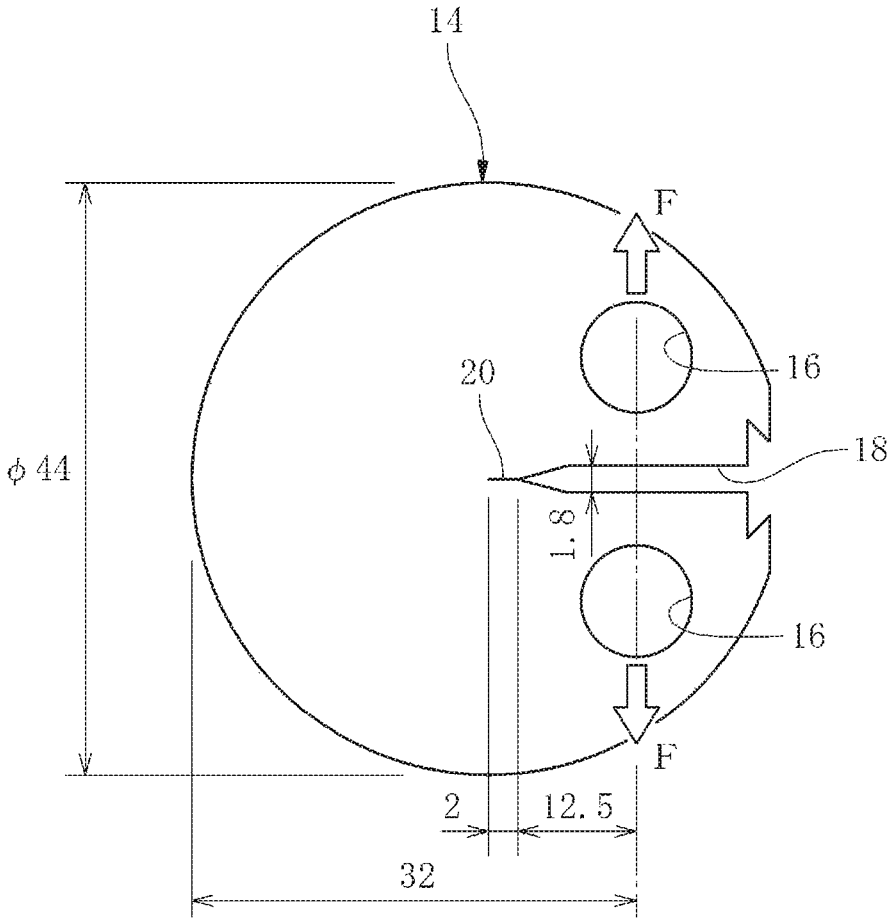
FIG. 2 is a view which shows the shape of the fracture toughness test specimen.

A material 12 for the fracture toughness test was taken out from the Φ45-mm round bar as shown in FIG. 1(B), and the test specimen 14 shown in FIG. 2 was produced therefrom.

The test specimen 14 substantially has a disk shape which has a diameter of 44 mm and a thickness of 16 mm and in which a notch 18 extending from the periphery toward the center has been formed. Furthermore, a pair of circular holes 16 and 16 have been formed on both sides of the notch 18 in respective positions symmetrical about the notch 18.

The notch 18 has a length (depth from the line segment which connects the centers of the circular holes 16 and 16) of 12.5 mm, and a pre-crack 20 having a length of 2 mm has been formed from the tip of the notch 18 (total crack length, 14.5 mm).

A tensile load was applied to the test specimen 14 in the direction F shown in FIG. 2, and changes of the load and crack opening displacement were measured to determine a value of fracture toughness.

The test temperature was 25° C., and the test direction was the C-R direction (i.e., the direction for propagating the crack in a direction perpendicular to the axial direction). The loading speed was 250 N/s, and the pre-crack formation frequency was 10 Hz.

TABLE 1

| | | Chemical components (mass %; remainder: Fe) | | | | | | | | | | | Expression (1) | Expression (2) | Expression (3) | Aging conditions |
|---|---|---|---|---|---|---|---|---|---|---|---|---|---|---|---|---|
| | | C | Si | Mn | S | Cu | Ni | Cr | Mo | V | s-Al | Others | | | | |
| Invention Steel | 1 | 0.14 | 0.20 | 1.00 | 0.020 | 0.12 | 0.41 | 1.10 | 0.60 | 0.25 | 0.020 | — | 31 | 1.24 | 694 | 625° C. × 2 h |
| | 2 | 0.14 | 0.21 | 0.99 | 0.021 | 0.12 | 0.50 | 1.00 | 0.60 | 0.25 | 0.020 | — | 29 | 1.22 | 690 | 625° C. × 2 h |
| | 3 | 0.14 | 0.21 | 1.01 | 0.020 | 0.12 | 1.01 | 1.02 | 0.60 | 0.27 | 0.020 | — | 31 | 1.28 | 670 | 625° C. × 2 h |
| | 4 | 0.14 | 0.19 | 0.99 | 0.019 | 0.12 | 1.00 | 1.67 | 0.60 | 0.16 | 0.017 | — | 38 | 1.43 | 680 | 625° C. × 2 h |
| | 5 | 0.14 | 0.20 | 0.51 | 0.020 | 0.12 | 1.50 | 1.66 | 0.45 | 0.27 | 0.018 | — | 33 | 1.34 | 679 | 625° C. × 2 h |
| | 6 | 0.14 | 0.20 | 1.00 | 0.020 | 0.11 | 1.00 | 2.10 | 0.61 | 0.25 | 0.024 | — | 44 | 1.62 | 686 | 625° C. × 2 h |
| | 7 | 0.14 | 0.20 | 0.41 | 0.019 | 0.12 | 2.00 | 2.10 | 0.75 | 0.26 | 0.022 | — | 41 | 1.60 | 671 | 625° C. × 2 h |
| | 8 | 0.22 | 0.20 | 1.30 | 0.005 | 0.15 | 1.00 | 0.15 | 0.15 | 0.35 | 0.020 | — | 20 | 1.10 | 647 | 625° C. × 2 h |
| | 9 | 0.14 | 0.20 | 2.00 | 0.021 | 0.12 | 1.00 | 1.00 | 0.22 | 0.25 | 0.020 | — | 37 | 1.40 | 632 | 625° C. × 2 h |
| | 10 | 0.30 | 0.20 | 0.90 | 0.122 | 0.88 | 1.50 | 1.00 | 0.40 | 0.35 | 0.020 | — | 31 | 1.52 | 655 | 625° C. × 2 h |
| | 11 | 0.14 | 0.20 | 1.01 | 0.020 | 0.12 | 1.01 | 1.02 | 0.60 | 0.27 | 0.020 | Ti: 0.005 | 31 | 1.28 | 670 | 625° C. × 2 h |
| | 12 | 0.15 | 0.22 | 0.80 | 0.020 | 0.12 | 1.05 | 1.01 | 0.79 | 0.15 | 0.020 | Nb: 0.100 | 30 | 1.26 | 678 | 625° C. × 2 h |
| | 13 | 0.14 | 0.96 | 0.19 | 0.021 | 0.05 | 1.00 | 1.00 | 0.61 | 0.27 | 0.008 | Pb: 0.15 | 22 | 1.19 | 718 | 625° C. × 2 h |
| | 14 | 0.08 | 0.21 | 0.99 | 0.021 | 0.12 | 1.01 | 1.10 | 0.60 | 0.27 | 0.020 | Bi: 0.14 | 32 | 1.20 | 672 | 625° C. × 2 h |
| | 15 | 0.14 | 0.06 | 1.02 | 0.020 | 0.11 | 1.00 | 1.11 | 0.60 | 0.27 | 0.020 | Te: 0.003 | 32 | 1.29 | 669 | 625° C. × 2 h |
| | 16 | 0.31 | 0.20 | 1.01 | 0.022 | 0.12 | 0.99 | 1.00 | 0.60 | 0.27 | 0.039 | Ca: 0.002 | 31 | 1.56 | 671 | 625° C. × 2 h |
| | 17 | 0.14 | 0.21 | 1.00 | 0.019 | 0.13 | 1.01 | 1.10 | 0.60 | 0.74 | 0.020 | Pb: 0.14 | 33 | 1.51 | 672 | 625° C. × 2 h |

TABLE 1-continued

| | Chemical components (mass %; remainder: Fe) | | | | | | | | | | | Expression (1) | Expression (2) | Expression (3) | Aging conditions |
|---|---|---|---|---|---|---|---|---|---|---|---|---|---|---|---|
| | C | Si | Mn | S | Cu | Ni | Cr | Mo | V | s-Al | Others | | | | |
| | | | | | | | | | | | Ca: 0002 | | | | |
| 18 | 0.14 | 0.37 | 1.02 | 0.020 | 0.12 | 1.00 | 1.12 | 0.48 | 0.30 | 0.022 | — | 31 | 1.32 | 675 | 500° C. × 2 h |
| 19 | 0.14 | 0.34 | 1.00 | 0.020 | 0.12 | 0.50 | 1.12 | 0.65 | 0.32 | 0.022 | — | 32 | 1.33 | 694 | 550° C. × 2 h |
| 20 | 0.14 | 0.35 | 0.99 | 0.020 | 0.12 | 0.52 | 1.12 | 0.63 | 0.31 | 0.022 | — | 31 | 1.32 | 694 | 580° C. × 2 h |
| 21 | 0.14 | 0.34 | 0.98 | 0.020 | 0.12 | 0.51 | 1.12 | 0.64 | 0.30 | 0.022 | — | 31 | 1.31 | 695 | 675° C. × 2 h |
| 22 | 0.14 | 0.21 | 2.70 | 0.020 | 0.12 | 1.02 | 0.15 | 0.45 | 0.28 | 0.020 | — | 36 | 1.42 | 594 | 585° C. × 2 h |

TABLE 2

| | | Chemical components (mass %; remainder: Fe) | | | | | | | | | | | Expression (1) | Expression (2) | Expression (3) | Aging conditions |
|---|---|---|---|---|---|---|---|---|---|---|---|---|---|---|---|---|
| | | C | Si | Mn | S | Cu | Ni | Cr | Mo | V | s-Al | Others | | | | |
| Comparative Steel | 1 | 0.14 | 0.25 | 1.10 | 0.019 | 0.12 | 0.08 | 1.01 | 0.55 | 0.30 | 0.019 | — | 29 | 1.22 | 703 | 625° C. × 2 h |
| | 2 | 0.14 | 0.34 | 1.00 | 0.020 | 0.12 | 0.08 | 1.12 | 0.65 | 0.32 | 0.022 | — | 31 | 1.29 | 710 | 625° C. × 2 h |
| | 3 | 0.15 | 0.21 | 0.99 | 0.022 | 0.12 | 0.20 | 1.01 | 0.63 | 0.26 | 0.024 | — | 29 | 1.22 | 702 | 625° C. × 2 h |
| | 4 | 0.29 | 0.25 | 1.00 | 0.005 | 0.15 | 0.60 | 0.25 | 0.30 | 0.23 | 0.020 | — | 19 | 1.13 | 676 | 625° C. × 2 h |
| | 5 | 0.06 | 0.10 | 0.70 | 0.022 | 0.12 | 0.90 | 0.70 | 0.20 | 0.30 | 0.024 | — | 20 | 0.81 | 679 | 625° C. × 2 h |
| | 6 | 0.14 | 0.20 | 3.20 | 0.020 | 0.12 | 1.00 | 0.20 | 0.40 | 0.26 | 0.024 | — | 41 | 1.54 | 576 | 625° C. × 2 h |
| | 7 | 0.12 | 0.15 | 0.40 | 0.020 | 0.12 | 1.20 | 3.32 | 0.28 | 0.24 | 0.024 | — | 50 | 1.71 | 715 | 625° C. × 2 h |

TABLE 3

| | | Microstructure | Hardness before aging [HRC] | Hardness after aging [HRC] | Amount of hardening [HRC] | 0.2% proof stress [MPa] | Tensile strength [MPa] | Proof stress ratio | Fracture toughness value KIC [MPa · $m^{1/2}$] |
|---|---|---|---|---|---|---|---|---|---|
| Invention Steel | 1 | ○ (100%) | 28.9 | 34.4 | 5.5 | 892 | 1056 | ○ (0.84) | 68.9 |
| | 2 | ○ (100%) | 28.3 | 33.7 | 5.4 | 885 | 1019 | ○ (0.87) | 71.2 |
| | 3 | ○ (100%) | 30.0 | 34.7 | 4.7 | 935 | 1073 | ○ (0.87) | 73.5 |
| | 4 | ○ (100%) | 32.9 | 35.3 | 2.4 | 899 | 1108 | ○ (0.81) | 68.5 |
| | 5 | ○ (100%) | 31.0 | 35.5 | 4.5 | 932 | 1086 | ○ (0.86) | 64.5 |
| | 6 | ○ (100%) | 36.1 | 39.3 | 3.2 | 993 | 1181 | ○ (0.84) | 71.8 |
| | 7 | ○ (100%) | 35.9 | 39.4 | 3.5 | 1037 | 1220 | ○ (0.85) | 74.7 |
| | 8 | ○ (85%) | 26.0 | 30.3 | 4.3 | 820 | 951 | ○ (0.86) | 64.6 |
| | 9 | ○ (100%) | 33.5 | 36.0 | 2.5 | 908 | 1115 | ○ (0.81) | 67.5 |
| | 10 | ○ (100%) | 36.5 | 40.2 | 3.7 | 1034 | 1242 | ○ (0.83) | 51.9 |
| | 11 | ○ (100%) | 30.2 | 35.7 | 5.5 | 940 | 1092 | ○ (0.86) | 71.2 |
| | 12 | ○ (100%) | 33.6 | 41.2 | 7.6 | 1040 | 1243 | ○ (0.84) | 51.6 |
| | 13 | ○ (100%) | 27.9 | 34.5 | 6.6 | 928 | 1078 | ○ (0.86) | 70.8 |
| | 14 | ○ (100%) | 27.9 | 33.4 | 5.5 | 882 | 1049 | ○ (0.84) | 67.2 |
| | 15 | ○ (100%) | 30.4 | 35.6 | 5.2 | 944 | 1098 | ○ (0.86) | 71.8 |
| | 16 | ○ (100%) | 37.8 | 41.7 | 3.9 | 1048 | 1259 | ○ (0.83) | 56.7 |
| | 17 | ○ (100%) | 36.6 | 41.4 | 4.8 | 1059 | 1248 | ○ (0.85) | 64.3 |
| | 18 | ○ (100%) | 31.5 | 33.7 | 2.2 | 798 | 998 | ○ (0.80) | 65.3 |
| | 19 | ○ (100%) | 31.9 | 35.4 | 3.5 | 867 | 1077 | ○ (0.81) | 66.3 |
| | 20 | ○ (100%) | 31.7 | 36.7 | 5.0 | 912 | 1123 | ○ (0.81) | 70.5 |
| | 21 | ○ (100%) | 31.2 | 34.7 | 3.5 | 872 | 1087 | ○ (0.80) | 57.2 |
| | 22 | ○ (100%) | 32.9 | 35.2 | 2.3 | 907 | 1066 | ○ (0.85) | 55.3 |
| Comparative Steel | 1 | ○ (100%) | 28.7 | 35.3 | 6.6 | 937 | 1057 | ○ (0.89) | 42.1 |
| | 2 | ○ (100%) | 30.3 | 36.9 | 6.6 | 980 | 1115 | ○ (0.88) | 30.6 |
| | 3 | ○ (100%) | 28.1 | 33.9 | 5.8 | 913 | 1026 | ○ (0.89) | 46.2 |
| | 4 | ×F (70%) ferrite formation | 27.4 | 28.9 | 1.5 | 768 | 923 | ○ (0.83) | 56.7 |
| | 5 | ○ (87%) | 21.9 | 27.5 | 5.6 | 813 | 898 | ○ (0.91) | 67.9 |
| | 6 | ×M (82%) martensite formation | 36.4 | 38.8 | 2.4 | 998 | 1198 | ○ (0.83) | 52.5 |
| | 7 | ×M (62%) martensite formation | 39.2 | 42.1 | 2.9 | 1072 | 1256 | ○ (0.85) | 75.4 |

In the results given in Table 1 to Table 3, Comparative Steel 1 and Comparative Steel 2 each have a Ni content of 0.08% and Comparative Steel 3 has a Ni content of 0.20%. These values are less than 0.40%, i.e., the lower limit value in the present invention. Because of this, the fracture toughness values KIC of these Comparative Steels are below the desired value of 50 $MPa \cdot m^{1/2}$.

Comparative Steel 4 has a value of expression (1) which is an index of the formation of a bainite phase alone, of 19 which is smaller than 20, i.e., the lower limit value in the present invention. This comparative steel has a structure which is a mixture with ferrite. As a result, the degree of hardness increase due to the age hardening treatment is low, and the hardness thereof after the age hardening treatment is lower than in the Invention Steels.

Comparative Steel 5 has a value of expression (2) which is an index of hardness after age hardening, of 0.81 which is smaller than 0.82, i.e., the lower limit value in the present invention. The hardness thereof after the age hardening treatment is 27.5 HRC which is lower than the desired value of 28 HRC.

Comparative Steel 6 has a Mn content of 3.20% which is higher than 3.00%, i.e., the upper limit value in the present invention, and has a value of expression (3) which is an index for inhibiting the formation of island martensite, of 576 which is smaller than 600, i.e., the lower limit value in the present invention. This steel has a structure which is a mixture with martensite, and shows poor machinability.

Comparative Steel 7 has a Cr content of 3.32% which is higher than 3.00%, i.e., the upper limit value in the present invention. This steel has a structure which is a mixture with martensite, and shows poor machinability.

In contrast, Invention Steels 1 to 21, which satisfy the requirements according to the present invention, are satisfactory with respect to all the properties.

Although Examples according to the present invention have been described above, these are mere examples, and the present invention can be variously modified so long as the modifications do not depart from the gist of the present invention.

INDUSTRIAL APPLICABILITY

According to the present invention, it is possible to provide an age hardening type bainitic microalloyed steel having a higher fracture toughness value than conventional ones. This age hardening type bainitic microalloyed steel is suitable for use as parts required to have fracture toughness.

While the invention has been described in detail and with reference to specific embodiments thereof, it will be apparent to one skilled in the art that various changes and modifications can be made therein without departing from the spirit and scope thereof.

This application is based on a Japanese patent application filed on Mar. 5, 2014 (Application No. 2014-043044), the contents thereof being incorporated herein by reference.

The invention claimed is:

1. An age hardening bainitic microalloyed steel having a composition which comprises, in terms of mass %:

0.06-0.16% of C;
0.01-0.22% of Si;
0.10-3.00% of Mn;
0.001-0.200% of S;
0.001-2.00% of Cu;
more than 0.40% and 3.00% or less of Ni;
0.10-3.00% of Cr;
0.40-1.00% of Mo;
0.10-1.00% of V; and
0.001-0.100% of s-Al, with the remainder being Fe and unavoidable impurities, and which satisfies a value of the following expression (1) to be 20 or larger and a value of the following expression (2) to be 0.82 or larger:

$$3\times[C]+10\times[Mn]+2\times[Cu]+2\times[Ni]+12\times[Cr]+9\times[Mo]+2\times[V] \quad \text{expression (1);}$$

$$1.66\times[C]+0.18\times[Si]+0.27\times[Mn]+0.09\times[Ni]+0.32\times[Cr]+0.34\times[Mo]+0.44\times[V] \quad \text{expression (2),}$$

in which each [ ] in the expression (1) and the expression (2) indicates a content of the element shown therein in terms of mass %, and wherein the composition excludes Nb.

2. The age hardening bainitic microalloyed steel according to claim 1, wherein the composition further satisfies a value of the following expression (3) to be 600 or larger:

$$727+21.2\times[Si]-37.8\times([Mn]+[Ni])+13.5\times[Cr]+2.7\times[Mo] \quad \text{expression (3),}$$

in which each [ ] in the expression (3) indicates a content of the element shown therein in terms of mass %.

3. The age hardening bainitic microalloyed steel according to claim 1, further comprising, in terms of mass %:

up to 0.300% of Ti.

4. The age hardening bainitic microalloyed steel according to claim 1, further comprising, in terms of mass %, one or more of:

0.001-0.300% of Pb;
0.001-0.300% of Bi;
0.001-0.300% of Te; and
0.001-0.010% of Ca.

5. The age hardening bainitic microalloyed steel according to claim 2, further comprising, in terms of mass %:

up to 0.300% of Ti.

6. The age hardening bainitic microalloyed steel according to claim 2, further comprising, in terms of mass %, one or more of:

0.001-0.300% of Pb;
0.001-0.300% of Bi;
0.001-0.300% of Te; and
0.001-0.010% of Ca.

7. The age hardening bainitic microalloyed steel according to claim 3, further comprising, in terms of mass %, one or more of:

0.001-0.300% of Pb;
0.001-0.300% of Bi;
0.001-0.300% of Te; and
0.001-0.010% of Ca.

8. The age hardening bainitic microalloyed steel according to claim 4, further comprising, in terms of mass %, one or more of:

0.001-0.300% of Pb;
0.001-0.300% of Bi;
0.001-0.300% of Te; and
0.001-0.010% of Ca.

* * * * *